US007210511B2

(12) United States Patent
Loth

(10) Patent No.: US 7,210,511 B2
(45) Date of Patent: May 1, 2007

(54) INTERMEDIATE PRODUCT, METHOD AND DEVICE FOR PRODUCING WOOD CHIPS

(75) Inventor: Robert Loth, Lage-Müssen (DE)

(73) Assignee: B. Maier Zerkleinerungstechnik GmbH, Bielefeld (DE)

( * ) Notice: Subject to any disclaimer, the term of this patent is extended or adjusted under 35 U.S.C. 154(b) by 289 days.

(21) Appl. No.: 10/432,295

(22) PCT Filed: Oct. 27, 2001

(86) PCT No.: PCT/EP01/12460

§ 371 (c)(1),
(2), (4) Date: Oct. 15, 2003

(87) PCT Pub. No.: WO02/42039

PCT Pub. Date: May 30, 2002

(65) Prior Publication Data

US 2004/0045633 A1 Mar. 11, 2004

(30) Foreign Application Priority Data

Nov. 25, 2000 (DE) ..... 100 58 626

(51) Int. Cl.
*B27L 11/00* (2006.01)

(52) U.S. Cl. ..... 144/373; 144/162.1; 144/172; 144/174; 241/28; 241/92

(58) Field of Classification Search ..... 144/174, 144/172, 176, 173, 218, 220, 162.1, 373, 144/369, 370; 241/92, 277, 101.74, 278.1, 241/28, 248, 260

See application file for complete search history.

(56) References Cited

U.S. PATENT DOCUMENTS

| | | | | | |
|---|---|---|---|---|---|
| 2,874,909 | A | | 2/1959 | Pallmann | 241/28 |
| 4,009,837 | A | * | 3/1977 | Schnyder | 241/93 |
| 4,260,113 | A | * | 4/1981 | Maier et al. | 241/28 |
| 4,972,888 | A | * | 11/1990 | Dean | 144/172 |
| 5,205,496 | A | * | 4/1993 | O'Donnell et al. | 241/34 |
| 5,209,278 | A | * | 5/1993 | Carpenter et al. | 144/230 |
| 5,413,286 | A | * | 5/1995 | Bateman | 241/190 |
| 5,526,988 | A | * | 6/1996 | Rine | 241/23 |
| 5,692,548 | A | * | 12/1997 | Bouwers et al. | 144/174 |
| 5,762,122 | A | * | 6/1998 | Rice, Sr. | 144/373 |

(Continued)

FOREIGN PATENT DOCUMENTS

DE 26 39 123 B1 8/1976

(Continued)

*Primary Examiner*—Bena Miller
(74) *Attorney, Agent, or Firm*—Ohlandt, Greeley, Ruggiero & Perle, L.L.P.

(57) ABSTRACT

The invention relates to an intermediate product, a method for processing the intermediate product and a wood chipping device for processing the intermediate product. The intermediate product is substantially rod shaped and is sized in a range that includes between one and two times as oriented strand (OS) chips. The intermediate product is fed to a wood chipping device. The wood chipping device has a number of blades. The number of blades each have a number of cutting edges that run parallel to a blade ring axis, and which enclose a working chamber. The intermediate product is rotated about the blade ring axis and is aligned in such a way that it lies substantially parallel to the blade ring axis and is pressed by centrifugal force against the cutting edges.

1 Claim, 2 Drawing Sheets

U.S. PATENT DOCUMENTS 5,937,923 A * 8/1999 Bielagus et al. ..... 144/172
6,032,707 A * 3/2000 Morey et al. ..... 144/174

FOREIGN PATENT DOCUMENTS

DE 29 47 199 C2 11/1979
DE 299 13 779 U1 8/1999
DE 200 20 037 U1 11/2000
EP 0 301 996 2/1989
EP 1 033 212 A1 9/2000
FR 1031797 3/1953

* cited by examiner

INTERMEDIATE PRODUCT, METHOD AND DEVICE FOR PRODUCING WOOD CHIPS

CROSS REFERENCE TO RELATED APPLICATIONS

The present application is claiming priority of German Patent Application No. 100 58 626.0 filed on Nov. 25, 2000 and PCT Patent Application No. PCT/EP01/12460 filed on Oct. 27, 2001.

BACKGROUND OF THE INVENTION

1. Field of the Invention
2. Description of the Prior Art

The invention relates to a method as well as a device for producing wood chips. For this, there are basically two systems, which differ fundamentally from each other and which, accordingly, also produce different products.

The first system relates to so-called direct chippers. In it, uncut round timber is fed into a chute. Arranged parallel to the axis along which the wood is fed is a knife ring, which is equipped along its circumference with a large number of knives. The cutting edges of the knives run parallel to the knife ring. The knife ring can move in such a way that it plunges into the body of the round timber and is able to chip it. See, for example,

DE 2,947,199 C1.

Another design of direct chippers, which belongs to the first system mentioned, has a disk that is mounted so that it can pivot. The disk carries chipping knives on one of its side faces. The round timber or tree stumps are fed to this working face in a direction parallel to the fibers. Because the circumferential speeds of the individual face elements of the working face differ in magnitude, depending on whether the face element lies radially inward or radially outward, the chipping result also differs and this is detrimental to the quality.

The machines mentioned, which belong to the first system, serve, above all, to produce so-called oriented strand (OS) chips. The fibers of these chips are oriented along the lengthwise direction of the chip. The chip is extremely thin. It serves to produce boards of the same name, so-called oriented strand boards (OSB). These are regarded as being of high quality. They have great strength, so that they can be used as construction elements for the construction of prefabricated houses, for example.

The second system mentioned uses so-called knife ring chippers. These consist of a ring or collar that is made up of knives, whose cutting edges run, at least largely, parallel to the ring axis. The knife ring encloses a working chamber in which the chippings are introduced into a radially inner region through a filling shaft. A rotor spins the chippings radially outward against the inner face of the knife ring and thus against the cutting edges of the knives, where chipping takes place.

The intermediate product that is fed to the chipper consists of appreciably smaller particles, namely, chippings, that were produced beforehand in a chopping process. In quite generalized terms, they have, at least to an approximation, the size of a match box.

The chips that can be produced by a knife ring chipper differ quite fundamentally from the OS chips produced by the first-mentioned category of machines, which operate according to the first-mentioned system. They are essentially pin-shaped and are reminiscent of thin matches. These chips can be processed only into chipboards or particle boards.

However, particle boards are of only limited strength and, in particular, they have no special flexural strength. Thus, they cannot be used as construction elements, but instead find application in the furniture industry.

The advantages and drawbacks of machines of the first-mentioned system—direct chippers for producing OS chips—and of the second-mentioned system with the preceding stage for producing chippings and the final result of chips for particle boards can be summarized as follows:

Direct chippers require, in general, fresh wood, that is, tree trunks of, for example, one meter. Although they are capable of producing high-quality OS chips, they have comparatively large dimensions on account of the large dimensions of the intermediate product. Accordingly, it is extremely expensive to purchase them. The investment costs lie between one and three million DM. Accordingly, they also have relatively little flexibility in use.

Chippers, by contrast, are smaller, more flexible, and more advantageous in cost to purchase. However, they are not capable of producing OSB chips, but only the lower-quality matchlike chips for particle boards.

SUMMARY OF THE INVENTION

The object of the invention is to present a method or a device that allows so-called fresh wood as well as recycled wood to be used as intermediate product, has appreciably less construction volume than the known direct chippers, therefore requires lower investment costs, and is flexible in use and that is also fundamentally suitable for producing OSB chips.

This object is solved by the independent claims.

The inventor has thus freed himself of a widely held prejudice. He has resorted to the basic features of the knife ring chipper, but has fundamentally changed the conditions surrounding it. This relates, in particular, to the choice of the dimensions of the intermediate product. The latter has a greater first dimension than the dimension perpendicular to it, so that the intermediate product could be referred to as rod-shaped.

With a method in accordance with the invention and a corresponding device, it is now possible to use highly differing intermediate products, namely, both fresh wood of excellent quality and fresh wood of less good quality, such as dwarf timber and branches, as well as recycled wood. Coming into consideration here as recycled wood is, for example, wood packaging, which is very common.

The method and device in accordance with the invention can—as mentioned—produce high-quality OSB chips, but, at the same time, also chips of lesser quality. If different categories of chips are produced, these can be classified by a subsequent classification step.

DESCRIPTION OF THE FIGURES

The invention is explained in more detail on the basis of the drawing. Represented therein individually are the following.

DETAILED DESCRIPTION OF THE INVENTION

Figure 1:
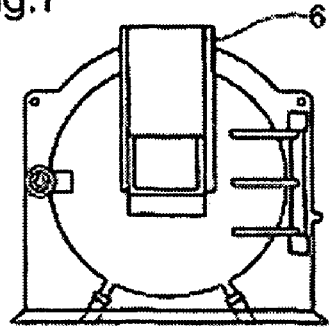
FIG. 1 shows a chipper in a front view, that is, in a view on that side on which the casing cover together with the spout for the intermediate product is situated.
Figure 2:
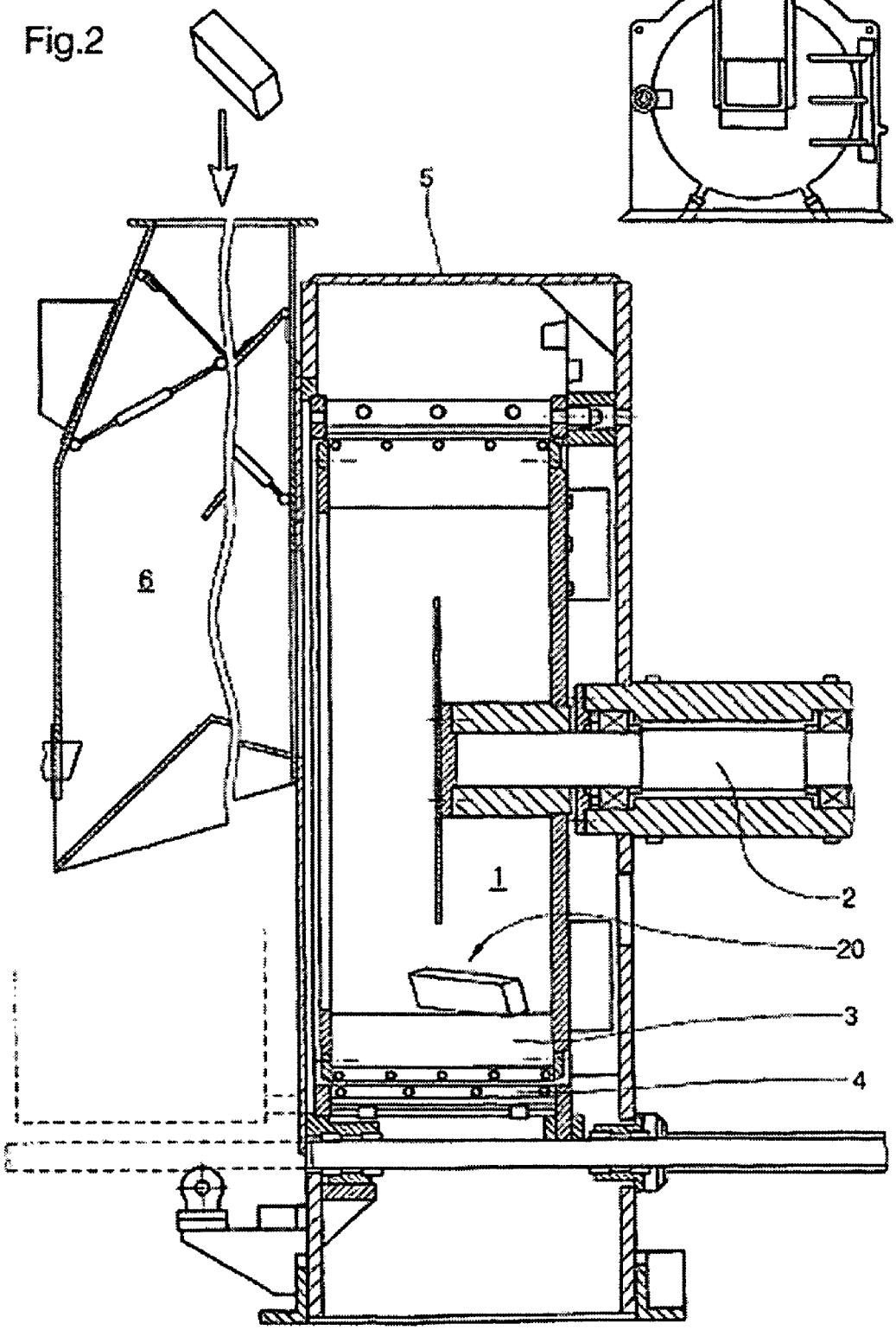
FIG. 2 shows, on an enlarged scale, an axial section of the chipper in accordance with FIG. 1.

As seen from FIGS. 1 and 2 individually, the chipper consists of a rotor, which is driven by a shaft 2. The rotor 1 contains a collar of blades 3, which are parallel to the axis. A knife box with knives 4, which are likewise arranged parallel to the axis, surrounds the rotor 1. Rotor 1 and the knife box are, in turn, arranged in a casing 5 and jointly enclosed by it. Casing 5 has a inlet 6 for the chippings that are to be fed in as well as a discharge for the finished chips.

FIG. 2 illustrates a rod-shaped intermediate product 20 at two sites. In the present case, this is delivered as a block in the shape of a regular rectangle. Instead, however, this intermediate product could be of a different shape—for example, it could have irregular peripheral surfaces. It is essential only that this intermediate product 20 be more or less rod-shaped; that is, it has a lengthwise dimension that is greater than the crosswise dimensions in planes running perpendicular to it.

The intermediate product 20 is fed into the shaft-shaped inlet 6—see arrow. It then arrives at the inner chamber that is enclosed by the rotor 1. In doing so, the intermediate product 20 comes to lie—either automatically or by means of a corresponding orienting device—in such a way that it is oriented mainly along the lengthwise axis of the rotor shaft 2 and thus more or less parallel to the knives 4. The intermediate product is of substantial size and particularly of substantial length in comparison with the chippings that are fed to the knife ring chippers that have been commonly used up to now. The intermediate product may be characterized by a length of 80 to 150 mm. The intermediate product may be characterized by a width with a magnitude of at least 20 mm.

Figure 3:
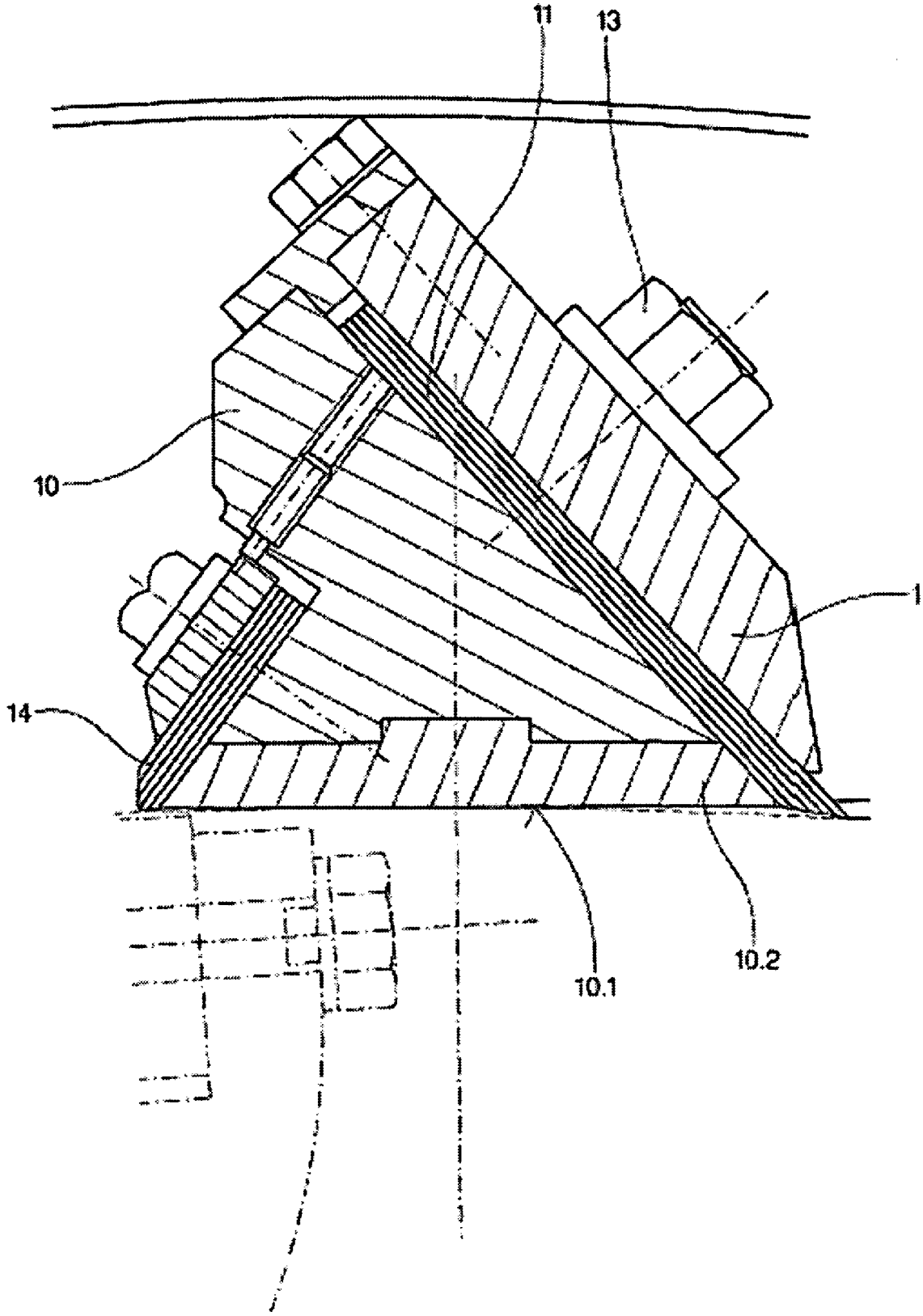
FIG. 3 shows, in an enlarged representation, a section taken from FIG. 2, namely, a knife set.

In FIG. 3, two knife sets are represented in a section perpendicular to the axis. These two knife sets are each a component of the knife ring of the machine.

Each knife set is constructed as follows: A supporting bedplate 10 bears a cutting knife 11, which is attached to the supporting bedplate 10 by means of a clamping plate 12 and a screw 13.

The operating parameters, such as the shape of the knife and the knife angle. may be chosen in such a way that they afford a chip thickness of 0.2 to 0.6 mm. preferably 0.2 to 0.4 mm.

Each supporting bedplate 10 has a wear surface 10.1. It is crucial that these wear surfaces 10.1, which face the machine axis, are nearly flat and thus not concentric, as in the prior art.

In the case of the figure here, the wear surface 10.1 is made up of a wear plate 10.2, which, in turn, is attached to the remaining supporting bed plate 10. The wear surface 10.1 is made up of a wear layer that is produced by application of a wear layer, preferably by build-up welding or spraying and subsequent smooth grinding.

In the embodiment in accordance with FIG. 3, a knife with M teeth, 14, is provided, which is attached to the side of the supporting bed plate 10 lying opposite to the cutting knife 11 and which works together with the cutting knife of the neighboring knife set. The embodiment is an embodiment without knives with M teeth.

A classification step may follow the chipping in order to determine whether the chips are to be classified according to criteria of their shape or their dimensions or their weight.

What is claimed is:

1. Method for producing oriented strand (OS) chips for the manufacture of OS boards, the method comprising:

producing an intermediate product from fresh wood or recycled wood, the intermediate product being substantially rod-shaped;

feeding the intermediate product into a chipping machine that has a large number of blades, the blades being arranged on a blade ring, the blades having cutting edges running at least approximately parallel to a ring axis and enclosing a working chamber;

rotating the intermediate product around the blade ring axis, the intermediate product being aligned to lie in such a way that it lies essentially parallel to the blade ring axis and is pressed by centrifugal force against cutting edges of the blades, the intermediate product having a length of 80 millimeters to 150 millimeters and a width of in an order of at least 20 millimeters, the blades having a blade angle that produces OS chips with a thickness of 0.2 millimeters to 0.6 millimeters;

sifting the intermediate product upstream of the feeding to only allow through a portion of the intermediate product having specific dimensions; and classifying the OS chips according to design, dimensions, or weight.

* * * * *